US012523416B2

(12) United States Patent
Karanjikar et al.

(10) Patent No.: US 12,523,416 B2
(45) Date of Patent: Jan. 13, 2026

(54) REFRIGERATOR AND SHELVING SYSTEM FOR A REFRIGERATOR

(71) Applicant: WHIRLPOOL CORPORATION, Benton Harbor, MI (US)

(72) Inventors: Anant Karanjikar, St. Joseph, MI (US); Umakant Suresh Katu, Glen Allen, MI (US); Vishal Shankar Marathe, Pune (IN); Kailash Shravan More, Pune (IN); Vinay M. Patil, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 183 days.

(21) Appl. No.: 18/319,074

(22) Filed: May 17, 2023

(65) Prior Publication Data

US 2023/0375253 A1 Nov. 23, 2023

Related U.S. Application Data

(60) Provisional application No. 63/344,298, filed on May 20, 2022.

(51) Int. Cl.

| | |
|---|---|
| ***F25D 25/02*** | (2006.01) |
| ***A47B 96/02*** | (2006.01) |
| *A47B 46/00* | (2006.01) |

(52) U.S. Cl.

CPC ..... *F25D 25/02* (2013.01); *A47B 96/025* (2013.01); *F25D 25/024* (2013.01); *A47B 46/00* (2013.01); *F25D 2325/021* (2013.01)

(58) Field of Classification Search

CPC .. F25D 25/02; F25D 25/024; F25D 2325/021; F25D 23/063; F25D 2331/803;

(Continued)

(56) References Cited

U.S. PATENT DOCUMENTS

| | | | |
|---|---|---|---|
| 7,316,326 | B2 | 1/2008 | Kim et al. |
| 7,618,103 | B2 | 11/2009 | Kim |

(Continued)

FOREIGN PATENT DOCUMENTS

| | | | |
|---|---|---|---|
| CN | 106524660 | A * | 3/2017 |
| CN | 109764624 | A * | 5/2019 |

(Continued)

*Primary Examiner* — Kimberley S Wright

(74) *Attorney, Agent, or Firm* — BROOKS KUSHMAN P.C.

(57) ABSTRACT

A refrigerator shelving system includes a stationary shelf, a pair of first and second sliders supported under opposite sides of the stationary shelf and configured to move longitudinally front and rear support tabs associated with each of the sliders and longitudinally spaced from each other, and a folding shelf. A front pair of opposing suspenders have first portions pivotally attached to the sliders and a second portions pivotally attached to the folding shelf. A rear pair of opposing suspenders have first portions pivotally attached to the sliders and second portions pivotally attached to the folding shelf. The folding shelf is movable from a deployed position, in which the front and rear suspenders are vertical to place the folding shelf under, and spaced from, the stationary shelf, to a folded position in which the front and rear suspenders are horizontal and disposed on top surfaces of the front and rear support tabs to nest the folding shelf under the stationary shelf.

17 Claims, 8 Drawing Sheets

(58) Field of Classification Search
CPC . F25D 2331/809; A47B 96/025; A47B 46/00; A47B 46/005; A47B 43/003
See application file for complete search history.

(56) References Cited

U.S. PATENT DOCUMENTS

| | | | | |
|---|---|---|---|---|
| 7,950,756 | B2 | 5/2011 | Collins et al. | |
| 10,408,531 | B1 * | 9/2019 | Beck | A47B 73/008 |
| 11,435,133 | B1 * | 9/2022 | Barik | F25D 25/02 |
| 2006/0125362 | A1 * | 6/2006 | Kim | F25D 25/024 312/408 |
| 2009/0058247 | A1 * | 3/2009 | Collins | F25D 25/02 62/440 |
| 2014/0252937 | A1 * | 9/2014 | Lee | F25D 25/02 312/404 |
| 2016/0146532 | A1 * | 5/2016 | Choo | F25D 25/024 312/408 |
| 2020/0088460 | A1 | 3/2020 | Beck | |
| 2022/0273097 | A1 * | 9/2022 | Beck | F25D 25/02 |
| 2023/0235949 | A1 * | 7/2023 | Karanjikar | F25D 25/02 312/408 |

FOREIGN PATENT DOCUMENTS

| | | | |
|---|---|---|---|
| CN | 109764626 | B * | 3/2023 |
| EP | 0917639 | B1 | 6/2000 |
| EP | 2606301 | B1 | 12/2016 |
| WO | 2012022653 | A2 | 2/2012 |

* cited by examiner

REFRIGERATOR AND SHELVING SYSTEM FOR A REFRIGERATOR

CROSS-REFERENCE TO RELATED APPLICATIONS

This application claims the benefit of U.S. provisional application Ser. No. 63/344,298 filed May 20, 2022, the disclosure of which is hereby incorporated in its entirety by reference herein.

TECHNICAL FIELD

The present disclosure relates to an appliance such as a refrigerator and more particularly to a folding shelf of the refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

According to one embodiment, a refrigerator shelving system includes a stationary shelf having at least one hook protruding therefrom and secured to an internal wall of a refrigerator via the at least one hook. The system further includes a pair of sliders supported under opposite sides of the stationary shelf and configured to move longitudinally. Front and rear support tabs are associated with each of the sliders and are longitudinally spaced from each other. The system also includes a folding shelf and a front pair of opposing suspenders having a first portion pivotally attached to the slider and a second portion pivotally attached to the folding shelf. A rear pair of opposing suspenders have a first portion pivotally attached to the slider and a second portion pivotally attached to the folding shelf. The folding shelf is movable from a deployed position, in which the front and rear suspenders are vertical to position the folding shelf under and spaced from the stationary shelf, to a folded position in which the front and rear suspenders are horizontal and disposed on top surfaces of the front and rear support tabs to nest the folding shelf under the stationary shelf.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
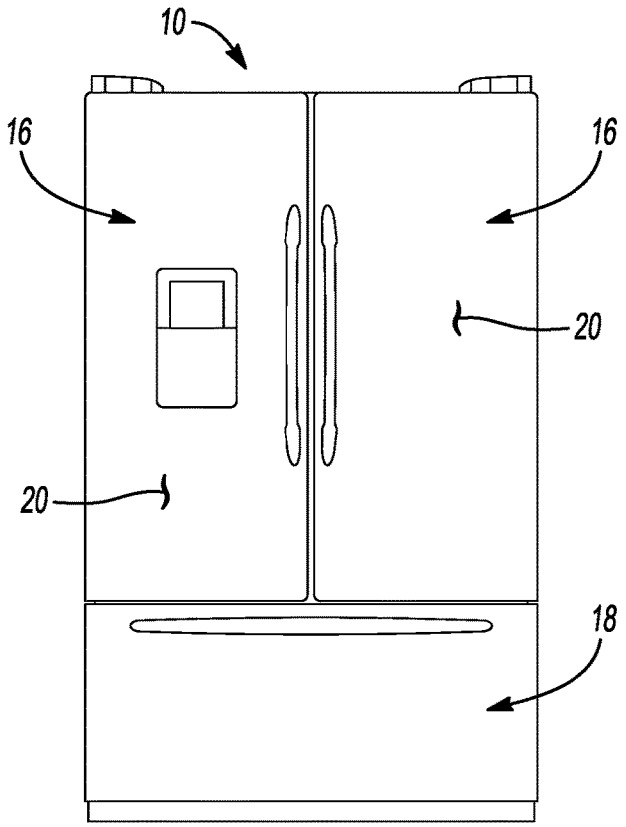
FIG. 1 is a front view of a refrigerator appliance.
Figure 2:
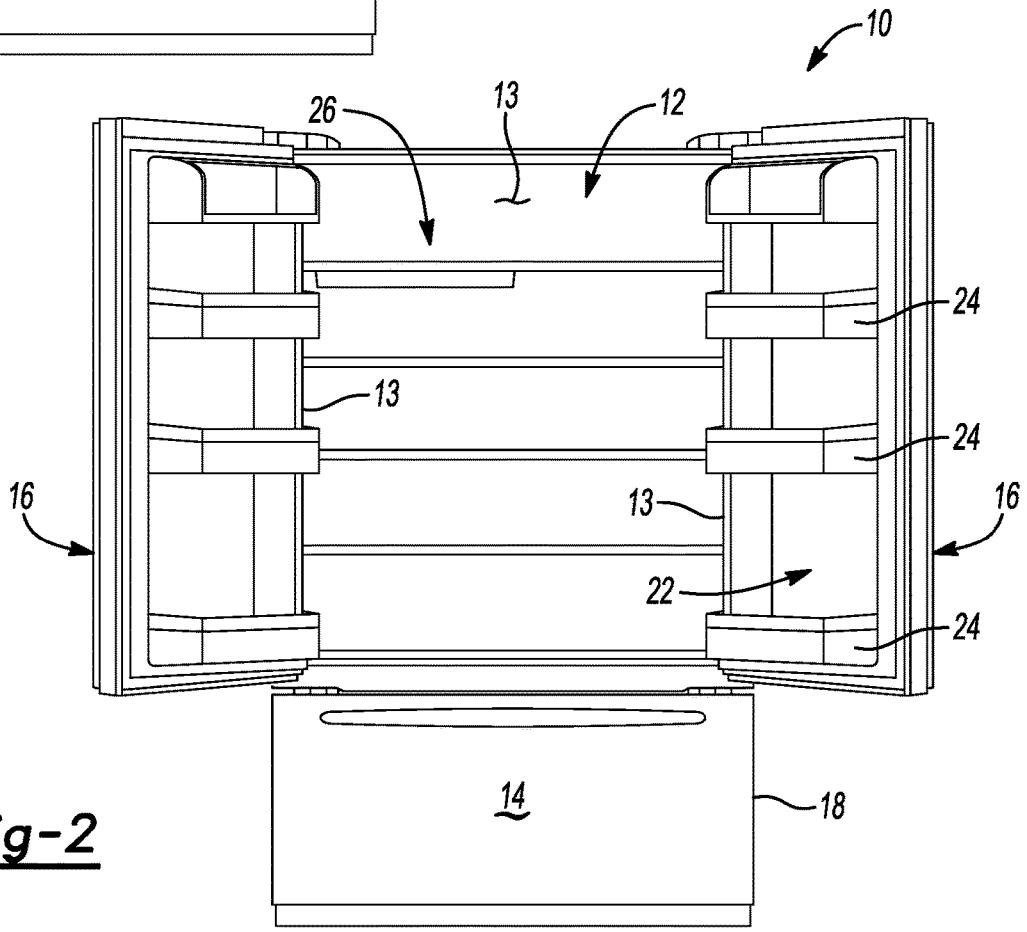
FIG. 2 is a front view of the refrigerator with the compartment doors open.

Referring to FIGS. 1 and 2, a refrigerator appliance 10 may be a french-door bottom-mount type as illustrated. However, it should be understood that this disclosure could apply to any type of refrigerator, such as a side-by-side, two-door bottom mount, or a top-mount. As shown in FIGS. 1 and 2, the refrigerator 10 may have a first internal storage chamber or fresh-food compartment 12 configured to refrigerate and not freeze consumables within the fresh-food compartment 12, and a second internal storage chamber or a freezer compartment 14 configured to freeze consumables within the freezer compartment 14 during normal use. The refrigerator 10 includes panels or internal walls 13 that form a housing and define the fresh-food compartment 12 and the freezer compartment 14. The walls 13 may form an internal liner of the refrigerator 10. The walls 13 may include a rear or back wall, a top wall, a bottom wall, and two side walls. One or more shelves may be secured to the walls 13 within the food compartment 12. The refrigerator 10 may have one or more doors 16, 18 that provide selective access to the compartments of the refrigerator 10 where consumables may be stored. As shown, the fresh-food compartment doors are designated 16, and the freezer door is designated 18. Alternatively, the fresh-food compartment may only have one door. The doors 16 may be pivotally attached to the walls 13 by one or more hinges or the like.

The freezer compartment 14 may be kept at a temperature well below the freezing point of water, e.g., zero degrees F., and the fresh-food compartment 12 is typically kept at a temperature above the freezing point of water and generally between a temperature of about 35° F. to 50° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may be a door liner. An insulating material, such as an insulating foam, may be disposed between the exterior panel 20 and interior panel 22 of each door 16 in order reduce the heat transfer from the ambient surroundings and increase the efficiency of the refrigerator. The insulating material may also surround the liner.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may be integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest) that extend from back and/or side surfaces of the interior panels 22 of each door 16.

Figure 3:
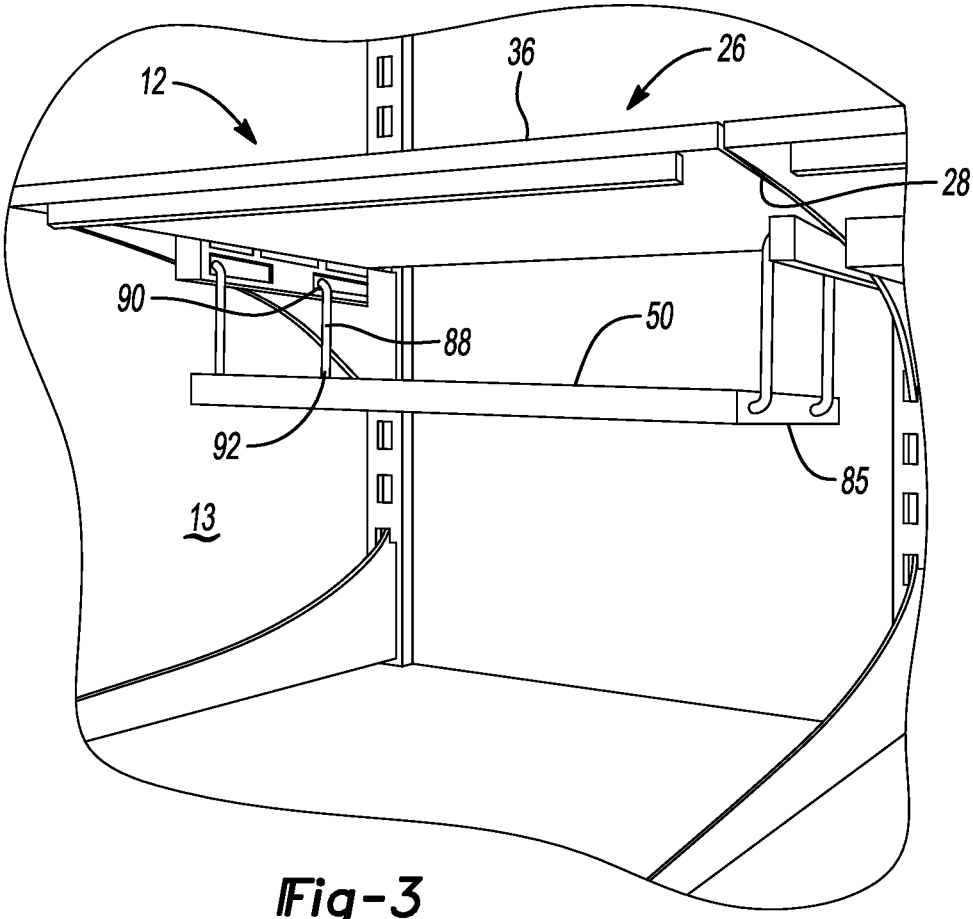
FIG. 3 is a front perspective view of a fresh-food compartment having a folding shelving system.
Figure 4:
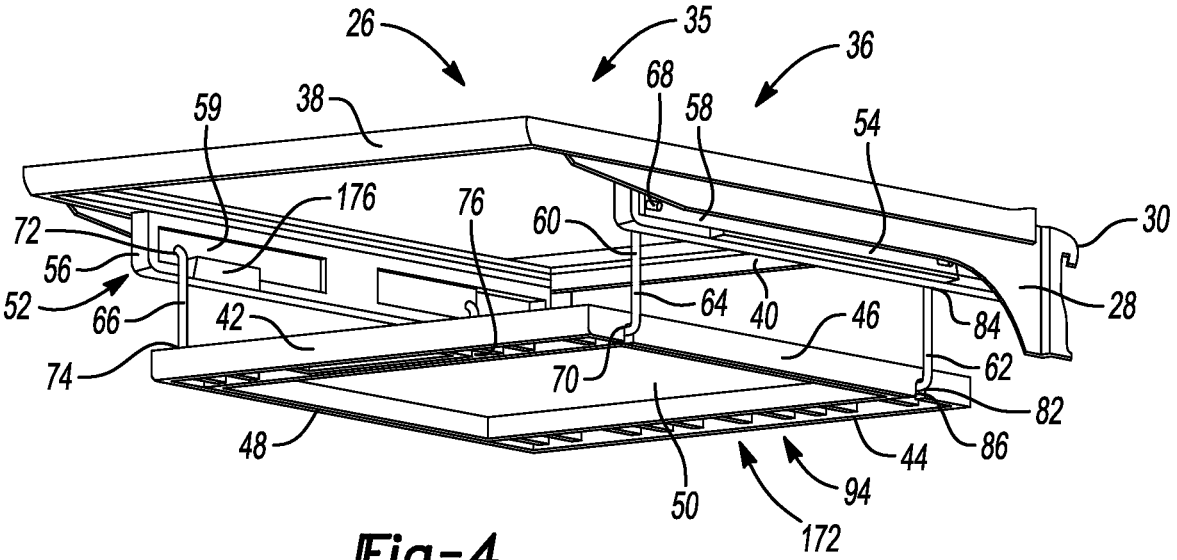
FIG. 4 is a perspective view of the shelving system shown in the deployed position.

Referring to FIGS. 3 and 4, a shelving system 26 for the refrigerator 10 is illustrated. The shelving system 26 may be disposed within the internal chamber (i.e., the fresh-food compartment 12) of the refrigerator 10. A single shelving system 26 or multiple shelving systems that are the same or similar to shelving system 26 may be disposed within the internal chamber of the refrigerator. It should be noted that any shelves illustrated in FIG. 2 may be removed or rearranged to create space for one or more of the shelving systems 26.

The shelving system 26 may include a stationary shelf 36 and a folding shelf 50 that is deployable underneath the stationary shelf 36. As will be explained in more detail below, the folding shelf 50 has a folded position in which it is nested under the stationary shelf 36 and a deployed position (shown) in which it is suspended under the stationary shelf 36 and provides additional shelving space.

One or more support arms 28 (also known as shelf brackets) support the stationary shelf 36 to the refrigerator. The support arms 28 engage one of the walls 13 that define the internal chamber 12 in order to secure the position of the shelving system 26 within the internal chamber 12. More specifically, hooks 30 defined on the end of the support arms 28 may extend into notches 32 defined by the wall 13 or a support structure attached to the wall. The hooks 30 may engage upwardly extending protrusions, bumps, walls, etc. within the notches 32 to secure the position of the shelving system 26 within the internal chamber 12. The wall 13 may define a plurality of vertically aligned notches 32 having protrusions disposed therein so that the shelving system 26 can be adjusted upward or downward between notches 32 in order to adjust a height of the shelving system 26 within the internal chamber 12.

The stationary shelf 36 may be secured to the support arms 28 such that the hooks 30 protrude from a rear of the stationary shelf 36, and such that the stationary shelf 36 is secured to the internal wall 13 via the hooks 30. The support arms 28 may be disposed along lateral sides of the stationary shelf 36. The support arms 28 may be built-in or integral to the stationary shelf 36 or a separate component. It is noted that a panel that defines an upper surface 35 of the stationary shelf 36 is illustrated as being made from a transparent material, such as glass, for illustrative purposes. It should also be noted that although the panel could be made from such a transparent material, this disclosure should not be construed as limited to such a configuration. The stationary shelf 36 has a front region or end 38, a back region or end 40, and a first length $L_1$ extending from the front end 38 to the back end 40.

The folding shelf 50 has a front end 42, a back end 44, and opposing sides 46, 48. A second length $L_2$ extending between the front 42 and the back 44 is shorter than the first length $L_1$ of the stationary shelf 36. The folding shelf 50 is also narrower in width (e.g., distance between the opposing sides 46, 48) than the stationary shelf 36. This allows the folding shelf 50 to nest under the stationary shelf 36 when in the folded position.

The shelving system 26 includes an actuator 52 for folding and unfolding the folding shelf 50. The actuator 52 may include a pair of side adapters 54, 56 supported under the stationary shelf 36. For example, the side adapters 54, 56 may be attached to the support arms 28. Sliders 58, 59 are supported within the side adapters 54, 56, respectively. The sliders 58 are configured to slide fore-and-aft within the side adapters 54, 56.

One or more hangers connect between the sliders 58, 59 and the folding shelf 50. For example, the folding shelf 50 is supported by a front hanger 60 and a rear hanger 62. Each of the hangers includes a pair of suspenders that are located on opposite sides of the shelving system 26. For example, the front hanger 60 includes a first suspender 64 having an upper end 68 pivotally attached to the slider 58 and a lower end 70 pivotally attached to the shelf 50, e.g., side 46, and a second suspender 66 having an upper end 72 pivotally attached to the slider 59 and lower end 74 pivotally attached to the shelf 50, e.g., the side 48. The first and second suspenders 64, 66 may be joined together by a horizontal portion, e.g., a rod 76, that connects between the lower ends 70 and 74. The rod 76 may extend along an underside of the folding shelf 50. In one or more embodiments, the suspenders and the rod are integrally formed. That is, the hanger 60 may be made from a single elongate member, e.g., a metal, that is bent to form the suspenders and horizontal portion. The rear hanger 62 includes a first suspender 82 having an upper end 84 pivotally attached to the slider 58 and a lower end 86 pivotally attached to the shelf 50, e.g., side 46, and a second suspender 88 having an upper end 90 pivotally attached to the slider 59 and lower end 92 pivotally attached to the shelf 50, e.g., side 48. The first and second suspenders 82, 88 may be joined together by a horizontal portion, e.g., a rod 94 that connects between the lower ends 86 and 92. The rod 94 may extend along an underside of the folding shelf 50. In one or more embodiments, the suspenders and the rod are integrally formed. That is, the hanger 80 may be made from a single elongate member, e.g., metal, that is bent to form the suspenders and horizontal portion. The front and rear hangers 60 and 62 cooperate to support and fold the folding shelf 50. The folding shelf 50 may include connection features 85 connecting with the hanger 60, 62. For example, the connection features 85 may be snaps that connect with the hangers.

Figure 5:
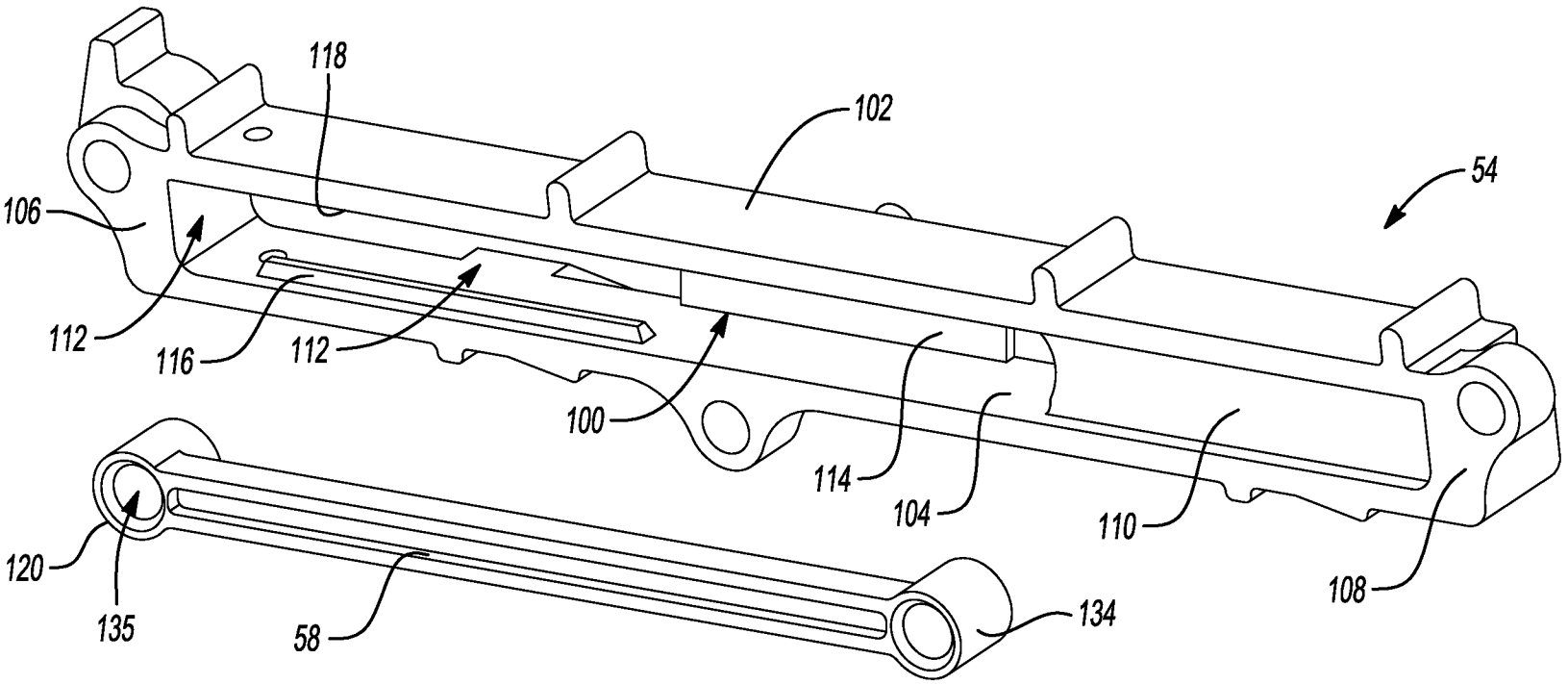
FIG. 5 is an exploded perspective view of slider and side adaptor of the shelving system.
Figure 6A:
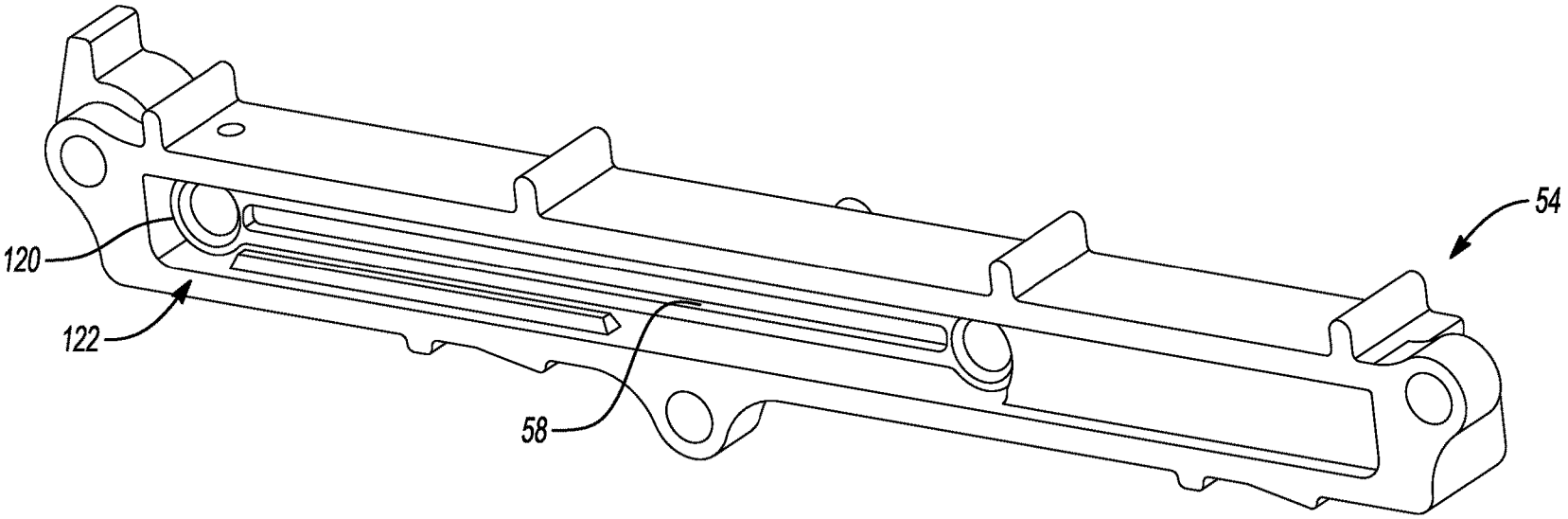
FIG. 6A is a side perspective view of the slider and side adaptor in a first position.
Figure 6B:
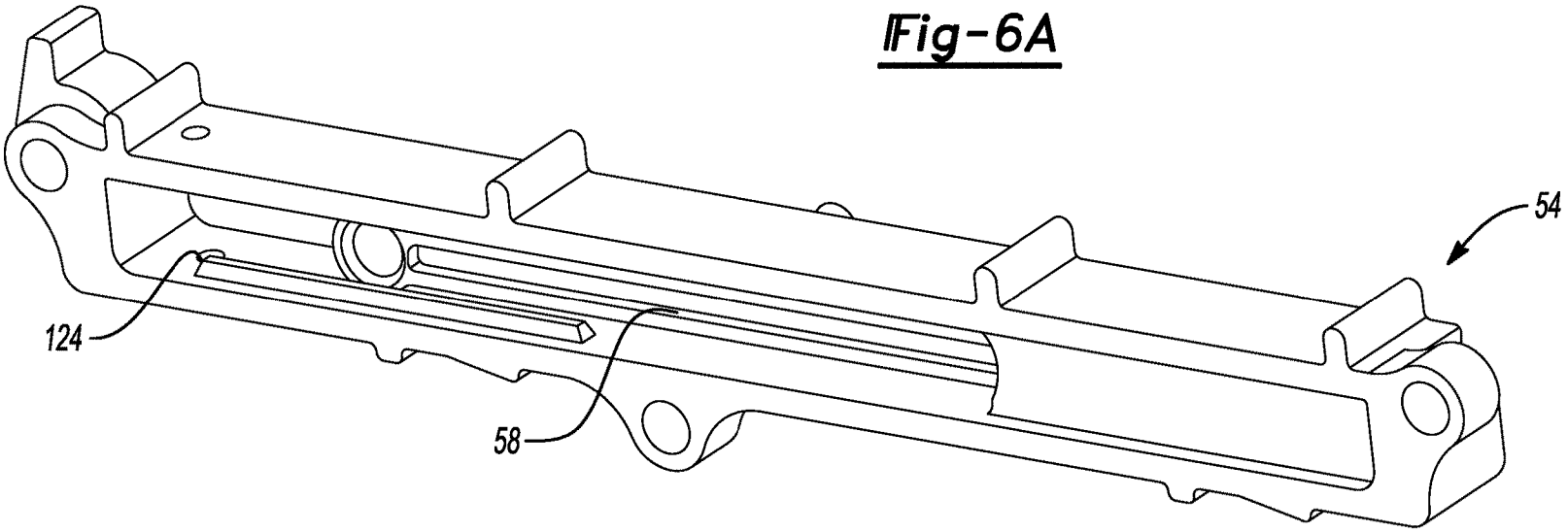
FIG. 6B is a side perspective view of the slider and side adaptor in a second position.
Figure 7:
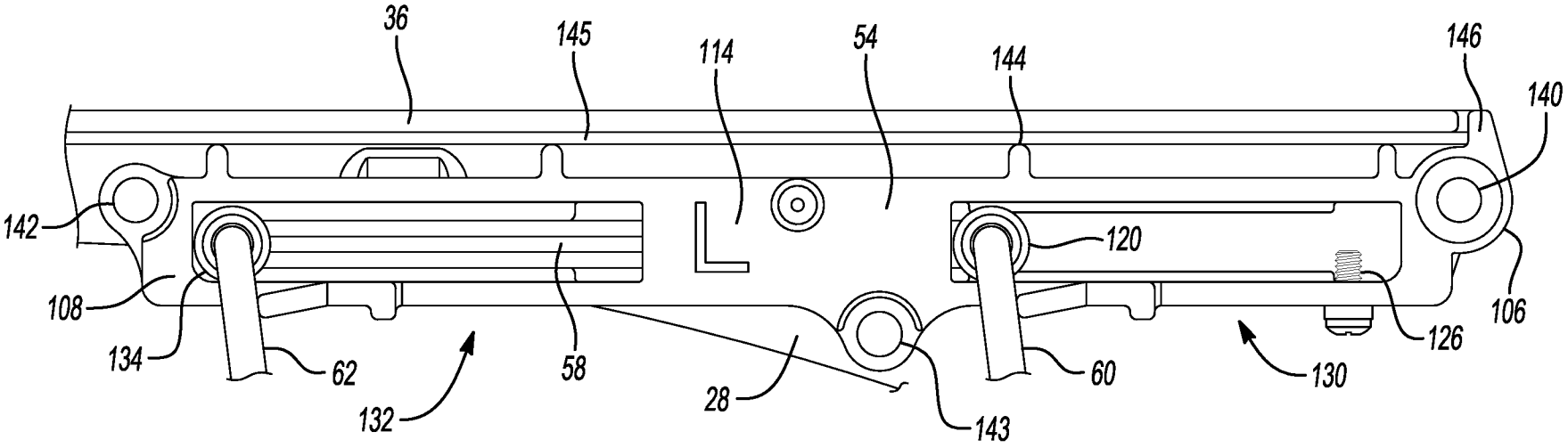
FIG. 7 is a side cross-sectional view of the shelving system.

FIGS. 5 to 7 show example embodiments of the side adapters and sliders. In this example, side adapter 54 defines a longitudinal channel 100 configured to receive the slider 58 therein. The channel 100 may be defined by a top portion 102, a bottom portion 104, a front portion 106, and a rear portion 108. The sides of the channel 100 are mostly open but side panels are placed in select locations to retain the slider 58 within the channel 100. For example, an outer side panel 110 extends vertically between the top 102 and the bottom 104 and extends longitudinally forward from the rear portion 108. The panel 110 only extends partially so that a receiving window 112 is formed. The receiving window 112 is sized to receive the slider 58 therein. An inner side panel 114 is on the other side of the channel 100. Unlike the outer side panel 110 that is located at the rear of the side adapter 54, the inner side panel 114 is located near the middle. The side panels 110 and 114 cooperate to laterally restrain the slider 58 within the channel 100. The side adapter 54 may also include ridges 116 and 118 that cooperate with the side panels 110, 114 to further laterally restrain the slider 54. The ridges 116, 118 may be laterally aligned with the side panel 110 and extend in the longitudinal direction of the channel 100. The ridge 118 may be an integrally formed raised projection extending downwardly from the top 102 and the ridge 116 may be an integrally formed raised projection extending upwardly from the bottom 104.

The slider 58 is received within the side adapter 54 by inserting the slider 58 through the window 112. The ridges 116 and 118 are spaced apart from the front end 106 providing clearance 122 for the circular boss 120 to be received within the window 112. Once the slider 58 is received within the channel 100, the ridges 116 and 118 engage with the circular boss 120 to secure the slider 58. The bottom portion 104 may define a threaded hole 124 that receives a stopper screw 126 that prevents the circular boss 120 from extending past the ridges 116, 118.

The side adapter 54 defines a pair of slots 130 and 132 on opposite sides of the inner panel 114. The slots provide openings for the front and rear hangers 60, 62 to connect with the slider 58. The front hanger 60 is connected to the circular boss 120 and the rear hanger 62 connects to a circular boss 134. The circular bosses 120 and 134 may define holes that receive the ends of the hangers 60, 62 therein. During operation, the hangers 60, 62 translate along the slots 130 and 132 allowing the assembly to move from the deployed position to the folded position and vice versa. The hangers 60, 62 may be connected to the circular bosses 120, 134 by inserting horizontal portions of the hangers into the holes 135 defined by the bosses 120, 134. In one embodiment, a snap fit may be used. This, of course, is just one embodiment, and any pivotal connection may be used. The slider 59 and the side adapter 56 may be of the same or similar structure and, for brevity, will not be repeated.

The side adapters 54, 56 may be attached to the side brackets 28 by a removable or nonremovable connection. In one embodiment, the side adapter defines holes 140, 142, and 143 that are configured to receive fasteners that connect the side adapter to the side support 28. The side adapters 54, 56 may include one or more vertical locators 144 and a horizontal locator 146. The locator(s) 144 is configured to engage with a bottom surface of a horizontal portion 145 of the side supports 28, and the locator 146 is configured to engage with an end of the horizontal portion 145.

Figure 8A:
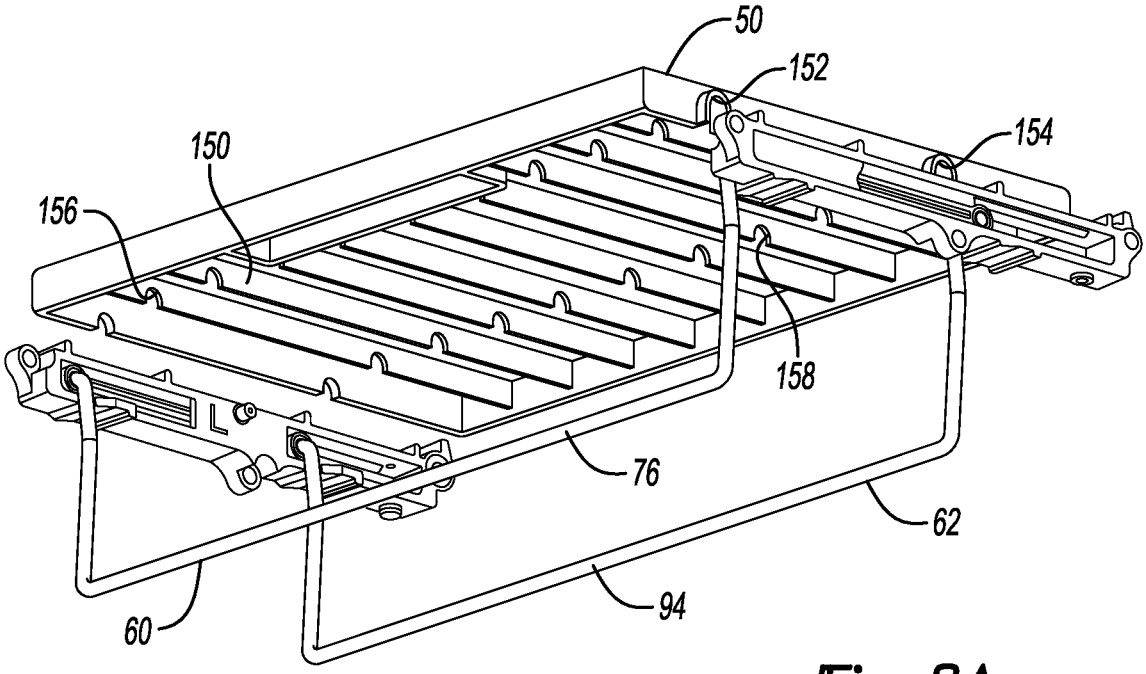
FIG. 8A is a partial exploded view of the shelving system.
Figure 8B:
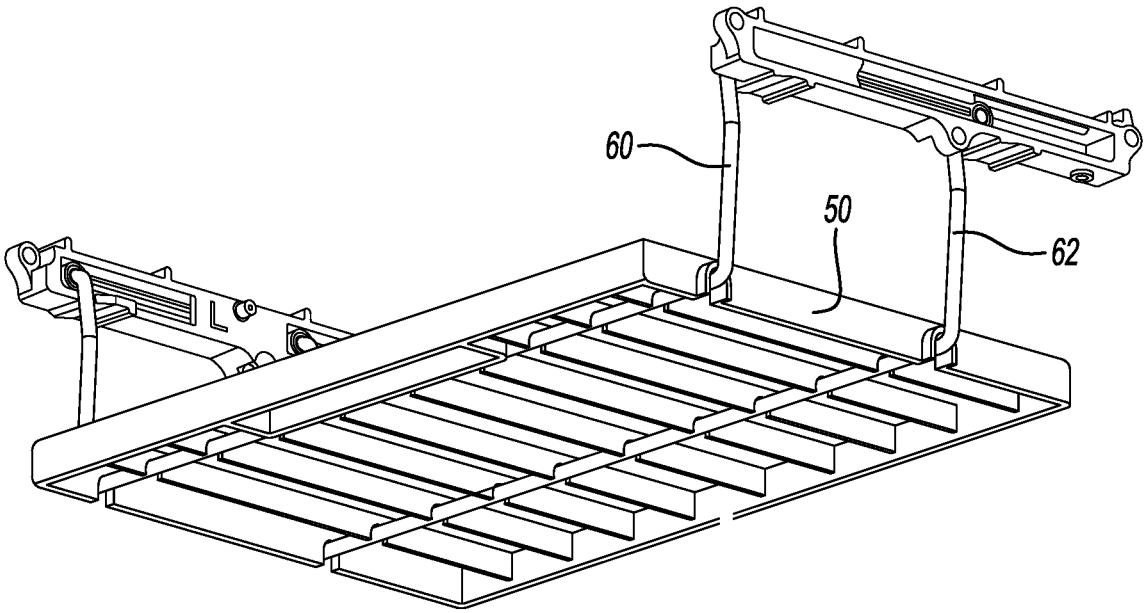
FIG. 8B is a partial perspective view of the shelving system.

Referring to FIGS. 8A and 8B, the folding shelf 50 is supported by the hangers 60, 62. For example, the folding shelf 50 may be supported on top of the rod portions 76, 94 of the hangers 60, 62. The folding shelf 50 may define connection features configured to engage with the rod portions 76, 94. In the illustrated embodiment, the folding shelf 50 includes outer sides 46, 48 and ribs 150. Each of the outer sides 46, 48 may include a first cutout 152 for the front hanger 60 and a rear cut out 154 for the rear hanger 62. Each of the ribs 150 may also define a front cutout 156 and a rear cut out 158. The front cutouts are arranged in a linear array to receive the front hanger 60 and the rear cutouts are arranged in a linear array to receive the rear hanger 62. These linear arrangements of cutouts form channels 157, 159 that receive the rod portions 76, 94, respectively. At least some of the cutouts include connection features for securing the shelf 50 to the hangers 60 and 62. The connection features may be a snap fit or the like. The connection features are designed to allow pivoting between the shelf 50 and the hangers 60, 62. In some embodiments, all of the cutouts may include connection features. In other embodiments only some of the cutouts include connection features. In one example, the cutouts of the sidewalls include connection features whereas the cutouts of the ribs do not. Alternatively, the cutouts of the ribs may include connection features whereas the cutouts of the sidewalls do not.

Figure 9:
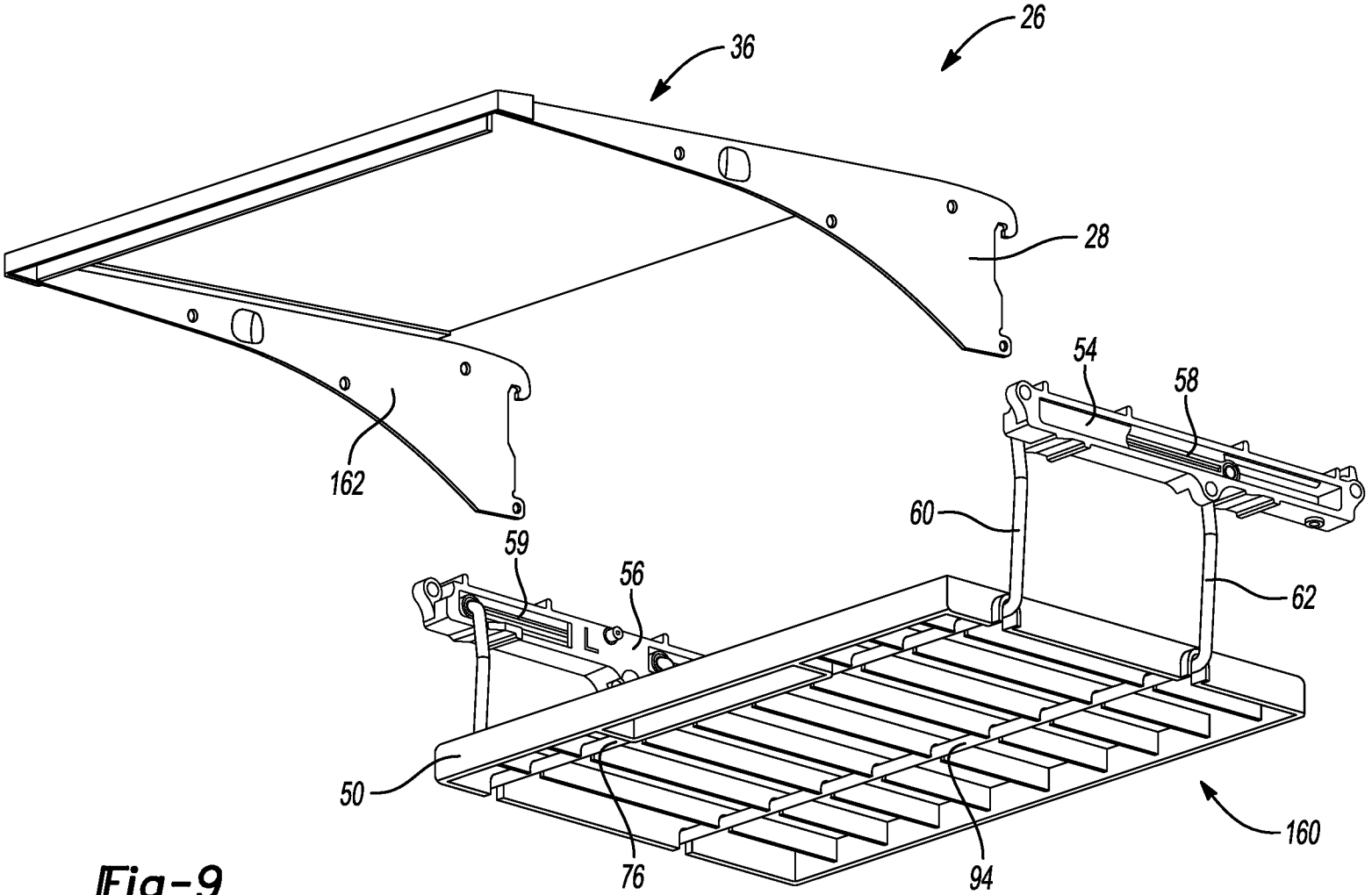
FIG. 9 is a partial exploded view of the shelving system.

Referring to FIG. 9, the shelving system 26 may be assembled by first assembling the sliders 58, 59 into the side adapters 54, 56. Next, the hangers 60, 62 are connected to the sliders 58, 59. The folding shelf 50 is then installed to the hangers 60, 62 by connecting the cutouts to the rod portions 76, 94. At this point, the folding assembly 160 is fully assembled. Now, the folding assembly 160 is attached to the stationary shelf 36. The width between the side adapters 54, 56 is less than the width between the side supports so that the folding assembly 160 fits underneath the stationary shelf 36. The side adapters 54, 56 are attached to the inner sides 162 of the brackets 28 as discussed above. This is but one example sequence for assembly, and the shelving system 26 may be assembled in other sequences.

Figure 10:
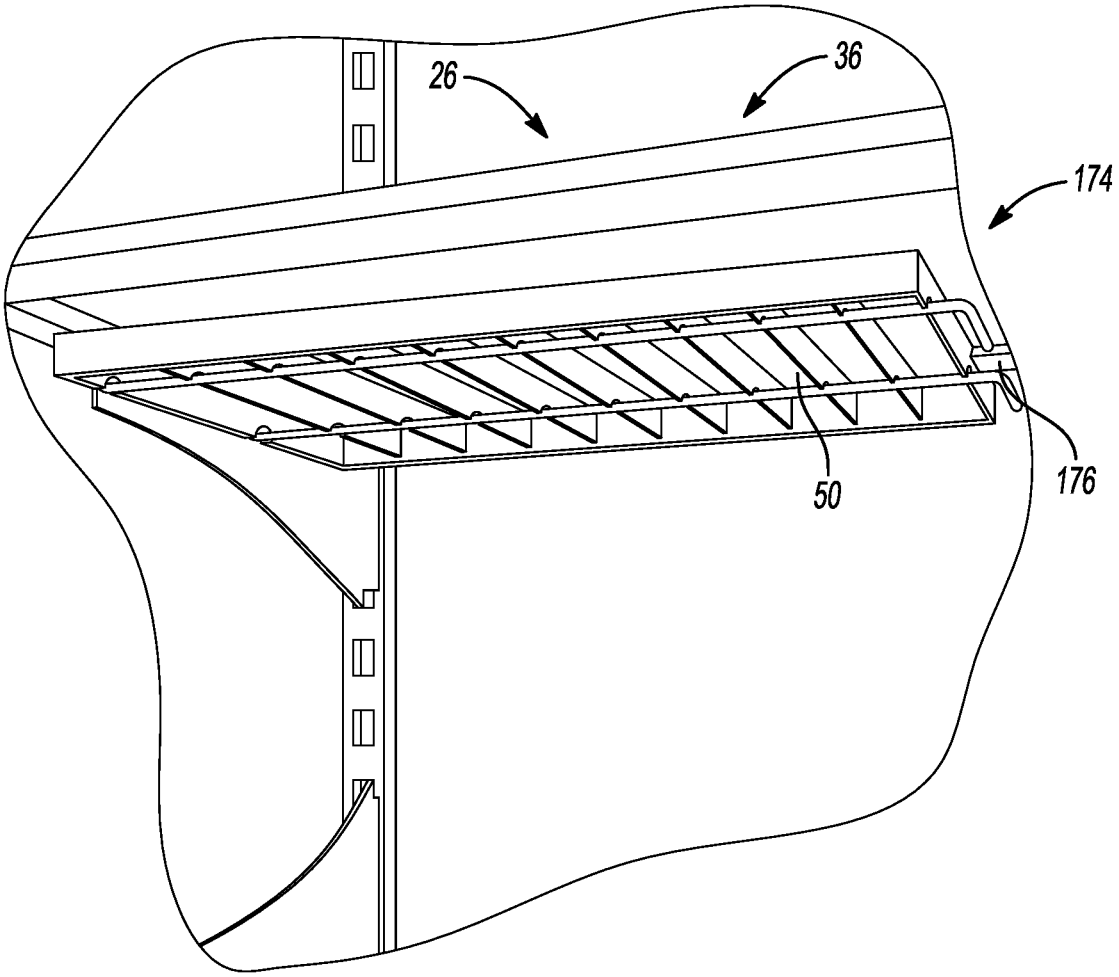
FIG. 10 is a perspective view of the shelving system shown in the folded position.

Referring to FIGS. 3, 4, and 10, the shelving system 26 is movable from a deployed position 172 to a folded position 174. The folding shelf 50 is moved to the folded position 174 by pulling the shelf 50 forward causing the shelf 50 to pivot upwardly about the hangers 60, 62. Once the folding shelf 50 is substantially horizontal and placed underneath the stationary shelf 36, pushing back on the front of the shelf 50 causes the sliders 58, 59 to slide backwards within the side adapters 54, 56 until the sliders bottom out. The side adapters 54, 56 include support tabs 176 that project from an inner side of the side adapters. The support tabs 176 are disposed under the suspenders of the hangers 60, 62 when in the folded position 174 to support the shelf 50. That is, a top surface of the support tabs 176 supports the hangers when the foldable shelf 50 is in the folded position. The front side of the support tabs 176 may include a chamfered, ramped, or rounded edge that facilitates sliding of the suspenders over the tops of the support tabs 176, e.g., the support tabs 176 are angled downwardly in a direction towards a front of the stationary shelf.

The shelving system is moved from the folded position 174 to the deployed position 172 by pulling the shelf 50 forward. This causes the sliders 58, 59 to slide forward until the suspenders move in front of the support tabs 176. The suspenders 60, 62 can now be pivoted downwardly to position the folding shelf 50 below the stationary shelf 36 and in the deployed position 172.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications

What is claimed is:

1. A refrigerator shelving system comprising:

a stationary shelf;

a pair of first and second sliders supported under opposite sides of the stationary shelf and configured to move between a forward position and a rear position, wherein each of the sliders defines a first hole and a second hole;

front and rear support tabs associated with each of the sliders, the front and rear support tabs being spaced from each other along a front-to-back direction of the stationary shelf;

a folding shelf;

a front pair of opposing suspenders having first portions pivotally attached to the sliders at the first hole and second portions pivotally attached to the folding shelf;

a rear pair of opposing suspenders having first portions pivotally attached to the sliders at the second hole and second portions pivotally attached to the folding shelf;

a first side adapter defining a first channel configured to slidably receive the first slider therein, and a second side adapter defining a second channel configured to slidably receive the second slider therein, the first and second side adapters each defining front slots and rear slots, such that the first portions of the front suspenders extend through the front slots, and the first portions of the rear suspenders extend through the rear slots, wherein the folding shelf is movable from a deployed position, in which the front and rear suspenders are vertical to place the folding shelf under, and spaced from, the stationary shelf, to a folded position in which the front and rear suspenders are horizontal and disposed on top surfaces of the front and rear support tabs to nest the folding shelf under the stationary shelf.

2. The refrigerator shelving system of claim 1, wherein the front and rear support tabs are angled downwardly in a direction towards a front of the stationary shelf.

3. The refrigerator shelving system of claim 1, wherein each of the front suspenders has a horizontal portion that is received in a corresponding one of the first holes, and each of the rear suspenders has a horizontal portion that is received in a corresponding one of the second holes.

4. The refrigerator shelving system of claim 1 further comprising a rod connected between the pair of front suspenders.

5. The refrigerator shelving system of claim 4, wherein the rod is integral with the front suspenders.

6. The refrigerator shelving system of claim 4, wherein the folding shelf defines a bottom channel that receives the rod therein.

7. The refrigerator shelving system of claim 1 further comprising a pair of support arms each having at least one hook protruding therefrom.

8. A refrigerator shelving system comprising:

a stationary shelf;

a folding shelf;

an actuator connecting the folding shelf to the stationary shelf, the actuator including:

left and right side adapters disposed under left and right sides of the stationary shelf, the side adapters defining left and right channels, respectively, left and right sliders slidably disposed in the left and right channels, respectively, each of the sliders having a front connector and a rear connector and each being slidable between a forward position and a rear position, a front hanger having a first end connected to one of the front connectors, a second end connected to the other of the front connectors, and an intermediate portion between the first and second ends, and a rear hanger having a first end connected to one of the rear connectors, a second end connected to the other of the rear connectors, and an intermediate portion between the first and second ends;

wherein the left and right side adapters each define front slots and rear slots, such that first portions of the front hangers extend through the front slots, and the first portions of the rear hangers extend through the rear slots, wherein the folding shelf is disposed on the intermediate portions, and the folding shelf is movable between (i) a deployed position spaced under the stationary shelf by a first distance and in which the sliders are in the forward positions and (ii) a folded position spaced under the stationary shelf by a second distance that is less than the first distance and in which the sliders are in the rear positions.

9. The refrigerator shelving system of claim 8, wherein the intermediate portions are disposed above bottoms of the side adapters when the folding shelf is in the folded position.

10. The refrigerator shelving system of claim 8, wherein the front and rear hangers are pivotal about the front and rear connectors.

11. The refrigerator shelving system of claim 8, wherein, for each of the first and second hangers, the first end, the second end, and the intermediate portion are portions of a common elongate member.

12. The refrigerator shelving system of claim 8, wherein the front hanger further includes a first suspender connected between the first end and the intermediate portion and a second suspender connected between the second end and the intermediate portion.

13. The refrigerator shelving system of claim 1, wherein the suspenders are substantially perpendicular to the intermediate portion of the front hanger.

14. The refrigerator shelving system of claim 8, wherein each of the side adapters includes a front support tab having a top surface, wherein the front hanger is disposed on the top surface when the folding shelf is in the folded position.

15. The refrigerator shelving system of claim 8, wherein each of the side adapters includes a rear support tab having a top surface, wherein the rear hanger is disposed on the top surface of the rear support tab when the folding shelf is in the folded position.

16. A refrigerator comprising:

a cabinet defining a refrigerator compartment;

a stationary shelf disposed in the refrigerator compartment;

left and right side adapters disposed under left and right sides of the stationary shelf, the left and right side adapters each defining front slots and rear slots;

left and right sliders slidably connected to the left and right side adapters, respectively, each of the sliders being slidable between a forward position and a rear position;

a front hanger having a first end connected to the left slider by extending through the front slot of the left side adapter, a second end connected to the right slider by extending through the front slot of the right side adapter, and an intermediate portion between the first and second ends;

a rear hanger having a first end connected to the left slider by extending through the rear slot of the left side adapter, a second end connected to the right slider by extending through the rear slot of the right side adapter, and an intermediate portion between the first and second ends; and a folding shelf disposed on the intermediate portions, wherein the folding shelf is movable between (i) a deployed position spaced under the stationary shelf by a first distance and in which the sliders are in the forward positions and (ii) a folded position spaced under the stationary shelf by a second distance that is less than the first distance and in which the sliders are in the rear positions.

17. The refrigerator shelving system of claim 16, wherein the intermediate portions are disposed above bottoms of the side adapters when the folding shelf is in the folded position.

* * * * *